United States Patent [19]

Uranishi et al.

[11] Patent Number: 4,962,744

[45] Date of Patent: Oct. 16, 1990

[54] DEVICE FOR DETECTING MALFUNCTION OF FUEL EVAPORATIVE PURGE SYSTEM

[75] Inventors: Kouji Uranishi, Susono; Takaaki Itou, Mishima, both of Japan

[73] Assignee: Toyota Jidosha Kabushiki Kaisha, Japan

[21] Appl. No.: 395,804

[22] Filed: Aug. 18, 1989

[30] Foreign Application Priority Data

Aug. 29, 1988 [JP] Japan ..... 63-112144[U]

[51] Int. Cl.[5] ..... F02M 39/00

[52] U.S. Cl. ..... 123/520; 123/198 D; 123/519; 123/494

[58] Field of Search ..... 123/518, 519, 520, 521, 123/494, 198 D, 479

[56] References Cited

U.S. PATENT DOCUMENTS

| | | | |
|---|---|---|---|
| 4,116,184 | 9/1978 | Tomita | 123/519 |
| 4,630,581 | 12/1986 | Shibata | 123/519 |
| 4,641,623 | 2/1987 | Hamburg | 123/518 |
| 4,809,667 | 3/1989 | Oranishi | 123/518 |
| 4,817,576 | 4/1989 | Abe | 123/519 |
| 4,846,135 | 7/1989 | Tiphaine | 123/520 |
| 4,867,126 | 9/1989 | Yonekawa | 123/198 D |
| 4,872,439 | 10/1989 | Sonada | 123/519 |

FOREIGN PATENT DOCUMENTS

| | | | |
|---|---|---|---|
| 55-29021 | 3/1980 | Japan . | |
| 57-171169 | 10/1982 | Japan . | |
| 0185966 | 10/1983 | Japan | 123/520 |
| 62-203039 | 9/1987 | Japan . | |
| 63-29050 | 2/1988 | Japan . | |
| 63-113158 | 5/1988 | Japan . | |
| 0150459 | 6/1988 | Japan | 123/519 |
| 0198767 | 8/1988 | Japan | 123/519 |

*Primary Examiner*—Carl Stuart Miller

*Attorney, Agent, or Firm*—Kenyon & Kenyon

[57] ABSTRACT

A device for detecting a malfunction of a fuel evaporative purge system comprises a temperature sensor for detecting a temperature inside a canister. During the absorbing and purging operations of the purge system, the device calculates changes in the temperature when absorbing and purging and compares the temperature changes with predetermined values denoting that the purge system is operating normally, and determines whether a malfunction has occurred in the purge system from the result of the comparison.

11 Claims, 4 Drawing Sheets

DEVICE FOR DETECTING MALFUNCTION OF FUEL EVAPORATIVE PURGE SYSTEM

BACKGROUND OF THE INVENTION

1. Field of the Invention

The present invention relates to a device for detecting malfunctions of a fuel evaporative purge system provided for emission control of an internal combustion engine, more particularly to a device for a system provided with a canister for absorbing and temporarily storing a fuel vapor, such as gasoline vapor, caused by an evaporation of fuel held in a fuel tank when a vehicle is stopped, the system separating the fuel vapor from an absorbent contained in the canister and supplying same into engine, to be burnt therein when the vehicle is running.

2. Description of the Related Art

In the conventional fuel evaporative purge system, a driver cannot be made aware of a malfunction of the purging mechanism from the canister until a periodical inspection of the engine is carried out. Therefore, if a malfunction occurs whereby the fuel vapor cannot be purged into the engine, the absorbent contained in the canister will become saturated, and thus fuel vapor from, for example, the fuel tank, will not be absorbed by the absorbent but will flow directly into the atmosphere through an air inlet of the canister.

To prevent this flow of fuel vapor into the atmosphere, a device for detecting a malfunction of the purge system is disclosed in which a fuel vapor sensor is provided at an air inlet of the canister for detecting the flow of fuel vapor through the air inlet to the atmosphere, and a malfunction of the purging mechanism of the system is detected by signals output from the sensor (Japanese Unexamined Utility Model Publication No. 57-171169).

In the above device, however, since the malfunction of the purging mechanism is first detected when the absorbent is saturated and cannot absorb any more fuel vapor, a time lag occurs between a time at which the purging mechanism malfunctions and a time at which the malfunction is detected, depending upon the absorption capability of the absorbent, and thus a warning that a malfunction has occurred is delayed.

Further, in this device, if the fuel vapor cannot be purged to the engine while the vehicle is running because of a malfunction of the system, a large quantity of fuel vapor which has not been absorbed in the absorbent may escape into the atmosphere when the fuel tank is filled with fresh fuel.

SUMMARY OF THE INVENTION

An object of the present invention is to provide a device for detecting a malfunction in a fuel evaporative purge system, which device can rapidly detect a malfunction of the purge system.

Therefore, according to the present invention, there is a provided a device for detecting a malfunction of a fuel evaporative purge system having a canister for absorbing fuel vapor from a fuel tank, said purge system absorbing the fuel vapor at least when a vehicle is stopped, and purging the fuel vapor held in said canister into an engine of said vehicle when said vehicle is running, said device comprising:

means for detecting a temperature inside said canister;

means for calculating a change of said temperature when absorbing the fuel vapor and a change of said temperature when purging the fuel vapor; and means for determining whether or not a malfunction has occurred in said system by comparing said changes of temperature calculated by said calculating means with predetermined values.

The present invention will be more fully understood from the description of the preferred embodiments thereof set forth below, together with the accompanying drawings.

DESCRIPTION OF THE PREFERRED EMBODIMENTS

Figure 1:
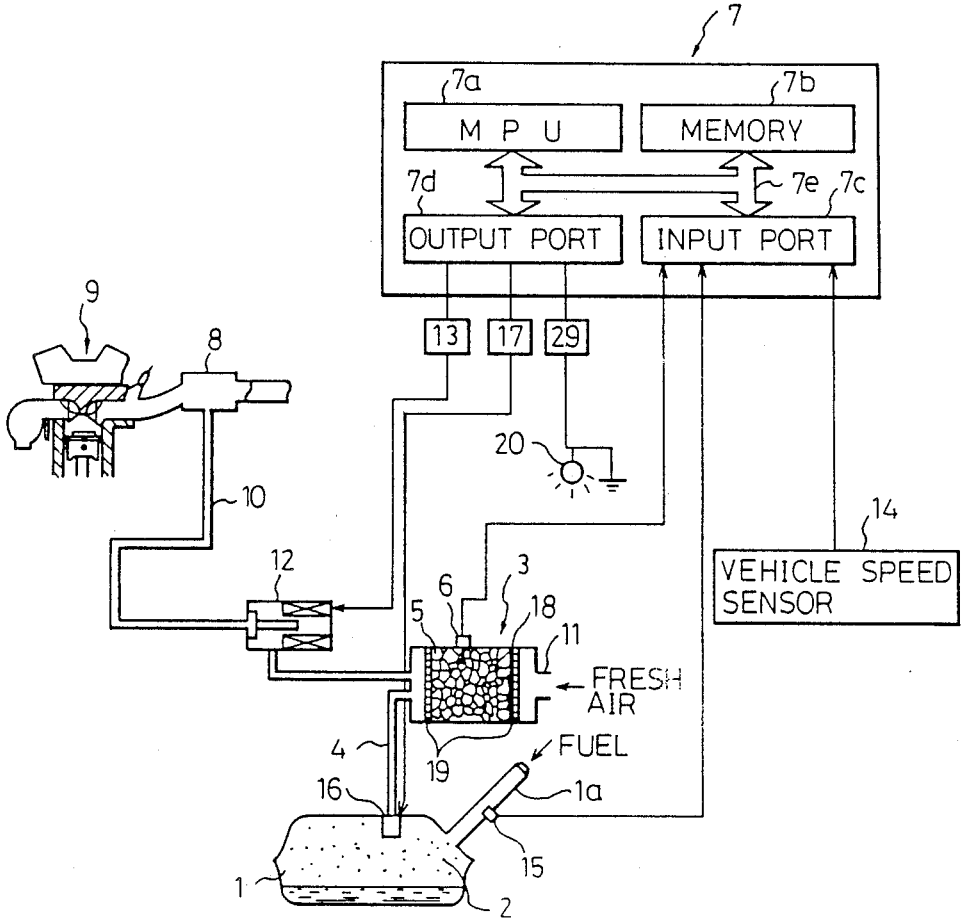
FIG. 1 is a schematic view of a device for detecting a malfunction of a fuel evaporative purge system according to a first embodiment of the invention.

FIG. 1 shows a malfunction detecting device according to the present invention when applied to a fuel evaporative purge system which absorbs fuel vapor caused by an evaporation of fuel held in a fuel tank when a vehicle (not shown) is stopped; in particular, when replenishing the fuel tank with fuel.

In FIG. 1, when a vehicle is stopped and a fuel tank 1 is then replenished with fuel, the fuel vapor 2 evaporating from the fuel tank 1 is fed to a canister 3 through a vapor passage 4. The canister 3 contains an absorbent 5, such as activated carbon, and the fuel vapor 2 is absorbed by this absorbent 5.

In general, the absorbent 5 generates heat due to an exothermic reaction thereof when absorbing the fuel vapor 2, and therefore, during the fuel replenishment, a temperature inside the canister 3 is raised by several tens of degrees (°C.) in comparison with a temperature inside the canister 3 before the fuel replenishment, i.e., close to the atmospheric temperature.

According to this embodiment of the present invention, a temperature sensor 6, which may be a known thermocoupling sensor, is inserted into the canister 3 to detect a temperature inside the canister 3, and signals output by the temperature sensor 6 are transmitted to a control circuit 7, the construction of which will be described later.

When the vehicle is run after the fuel replenishing is completed, a negative pressure is produced in an intake pipe 8 of the engine 9, i.e., an intake vacuum is introduced into the canister 3 through a purge passage 10 connecting the intake pipe 8 with the canister 3. Accordingly, the fuel vapor absorbed in the absorbent 5 is separated therefrom and purged into the intake pipe 8, together with fresh air introduced through an air inlet 11 provided in one side of the canister 3 opposite to the side thereof in communication with the vapor passage 4 and the purge passage 10. Note, to carry out the above-mentioned purging operation of the fuel evaporative purge system, a solenoid valve 12 is arranged in the purge passage 10 and is opened by the control circuit 7 through a drive circuit 13 when the vehicle is running. The drive circuit 13 is electrically connected to the control circuit 7, and upon receiving an "ON" signal from the control circuit 7, the drive circuit 13 opens the solenoid valve 12 to allow communication between the canister 3 and the intake pipe 8.

The actual driving condition of the vehicle is detected from signals input by a vehicle speed sensor 14 to the control circuit 7. The control circuit 7 outputs the "ON" signal to open the solenoid valve 12 when the actual driving condition detected by the vehicle speed sensor 14 satisfies a predetermined driving condition.

The control circuit 7 is constructed by a microcomputer which comprises a microprocessing unit (MPU) *7a*, a memory *7b*, and input port *7c*, an output port *7d*, and a bus *7e* interconnecting these components. As illustrated in FIG. 1, the signals from the above temperature sensor 6 and the vehicle speed sensor 14 are input to the input port *7c* of the control circuit 7. In addition to these sensors 6 and 14, according to this embodiment, a refuelling switch 15 is arranged at a fuel inlet 1*a* of the fuel tank 1 to determine whether or not the fuel tank 1 is being replenished with fuel. As with the signals from the sensors 6 and 14, signals from the refuelling switch 15 are input to the input port *7c*.

Furthermore, a valve 16 is arranged at a vapor inlet of the vapor passage 4 to intercept the flow of the fuel vapor 2 from the fuel tank 1 into the canister 3, except during a fuel replenishment. As for the solenoid valve 12, the valve 16 is activated by the control circuit 7 through a drive circuit 17. The operation of the valve 16 is such that, when the refuelling switch 15 is activated by a fuel replenishment, the control circuit 7 outputs an "ON" signal to the drive circuit 17, to open the valve 16 and allow the transfer of the fuel vapor 2 from the fuel tank 1 to the canister 3.

Note that, in the canister 3, 18 designates a filter for cleaning fresh air introduced through the air inlet 11, and 19 represents plates supporting the filter 18 and the absorbent 5 in the canister 3.

Figure 2:
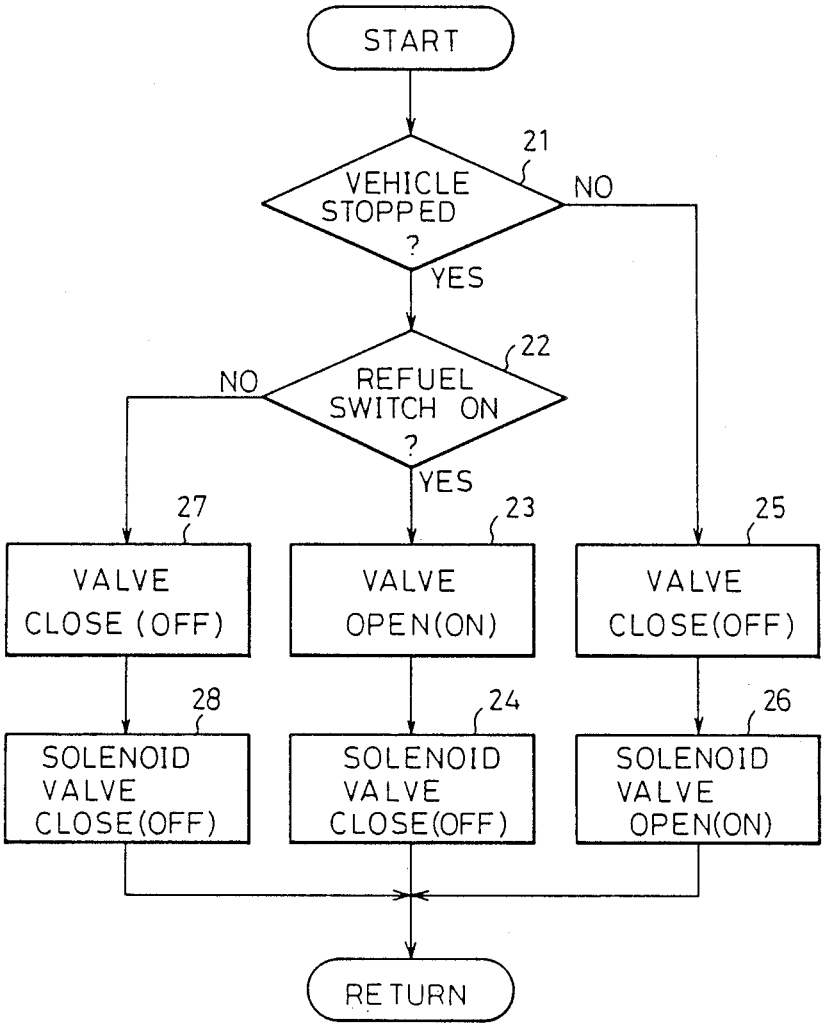
FIG. 2 is a flow chart of the routine for carrying out the absorbing and purging operations of the purge system.

FIG. 2 is a flow chart of a routine for carrying out the above operation of the purge system. This routine is executed independently from a main routine for carrying out a known control of the engine 9, since the former routine must be executed even when the engine 9 is stopped.

As shown in the figure, at step 21 it is determined whether or not the vehicle has stopped by detecting a signal output from the vehicle speed sensor 14. If YES at step 21, the process goes to step 22 where it is determined whether or not the fuel is being replenished by detecting a signal output from the refuelling switch 15. If NO at step 21, the process goes to step 25 and a process to be described later is carried out.

If YES at step 22, i.e., if the fuel is being replenished, the process goes to stop 23 where the valve 16 is opened by outputting an "ON" signal from the output port *7d* through the drive circuit 17, whereby the fuel vapor 2 evaporating from the fuel tank 1 is introduced into the canister 3. Then, at step 24, the solenoid valve 12 is closed to intercept the flow of the fuel vapor from the canister 3 to the intake pipe 8. As apparent from the above description, the processes at steps 23 and 24 provide for the absorption of the fuel vapor by the purge system.

If NO at step 21, the process goes to step 25 where the valve 16 is closed to intercept the flow of the fuel vapor 2 from the fuel tank 1 to the canister 3. Then, at step 26, the solenoid valve 12 is opened by outputting a "ON" signal from the output port *7d* through the drive circuit 13, whereby the fuel vapor 2 separated from the canister 3 is purged into the intake pipe 8.

If NO at step 22, i.e., the fuel is not being replenished although the vehicle has stopped, the process goes to step 27, at which the valve 16 is closed, and at step 28, the solenoid valve 12 is also closed.

After the execution of step 24, 26, or 28, the routine is ended and the process returns to the first step of the subsequent routine.

Although the above routine is directed to a purge system which purges the fuel vapor 2 whenever the vehicle is running, it is obvious that the purging process may be modified so that the purging is carried out when the speed of the vehicle is higher than a predetermined value.

In such a case, the process at step 21 may be changed to a process of determining whether or not the vehicle is running at speed higher than the predetermined speed, by detecting signals output from the vehicle speed sensor 14.

Figure 3:
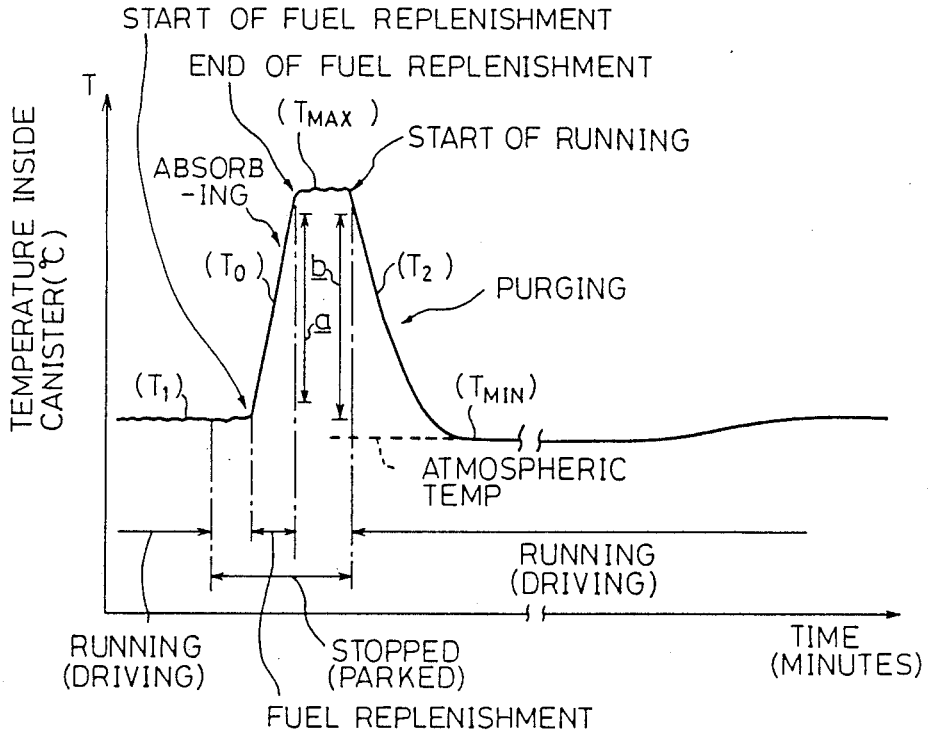
FIG. 3 shows a change in a temperature inside a canister when a normal absorption and a normal purging of fuel vapor are carried out; and, FIG. 4 is a flow chart of the routine carried out by a control circuit of the device in accordance with the present invention.

Note, when the vehicle is run after the fuel replenishing is completed, the solenoid valve 12 is opened to allow the purging of the fuel vapor from the canister 3 to the intake pipe 8 to begin. Consequently, the temperature inside the canister 3 gradually falls due to the separation of the fuel vapor from the absorbent 5, and finally, becomes close to the atmospheric temperature. FIG. 3 is a diagram showing a change of the temperature inside the canister 3 with a passage of time when, in the above mentioned purge system, the absorption and purging of the fuel vapor 2 are normally carried out. As shown in FIG. 3, in a normal operation of the purge system, the temperature increase inside the canister resulting from the absorption of the fuel vapor 2 is reduced to close to atmospheric temperature after a purge is carried out. Therefore, according to the present invention, by taking the change of the temperature inside the canister during a normal absorption and purging, which change is obtained by experiment, into account and comparing an actual change of the temperature calculated by the control circuit 7 with the above change, i.e., predetermined values at which a normal operation of the system is assured, it can be determined whether or not a malfunction has occurred in the purge system. In detail, if the absorption of the fuel vapor during a fuel replenishment (or when the vehicle is stopped) is normally accomplished, the following inequality is applicable, $$t_{max} - t_1 \geqq a \quad (1)$$

In the above inequality, $t_{max}$ represents an actual maximum of the temperature detected by the temperature sensor 6 after the fuel replenishment is completed or when the vehicle has stopped, $t_1$ represents an actual temperature detected by the temperature sensor 6, just before the fuel replenishment or the vehicle has stopped, and a represents a predetermined value obtained from FIG. 3, which takes into account any errors in measurement.

If the purging of the fuel vapor while the vehicle is running is normally accomplished, the following inequality is applicable:

$$t_{max} - t_2 \geqq b \quad (2)$$

In the above inequality, $t_2$ represents an actual temperature detected by the temperature sensor 6 while the vehicle is running after a fuel replenishment (or the vehicle has stopped) and b represents another predetermined value obtained from FIG. 3, which takes into account any errors in measurement.

Note, with regard to this inequality (2), since the temperature $t_2$ varies with the passing of time as well as with a temperature $T_2$ shown in FIG. 3, the temperature $t_2$ may be defined as a minimum temperature $t_{min}$ among temperatures detected within a predetermined period, for example, 30 minutes, after the vehicle is run.

According to this embodiment, when the difference between $t_{max}$ and $t_1$, which is calculated during an actual operation, does not meet the above inequality (1), it can be determined that a malfunction has occurred in the purge system, such as a ventilation blockage in the vapor passage 4, an abnormal action of the valve 16, a lowering of the absorption capability of the absorbent 5, etc.

Further, when the difference between $t_{max}$ and $t_2$, which is calculated during an actual operation, does not meet the above inequality (2), it can be determined that a malfunction has occurred in the purge system, such as a ventilation blockage in the purge passage 10, an abnormal action of the solenoid valve 12, a reduced ventilation of the canister 3 due to a blockage of the air inlet 11 or the filter 18 by foreign matter, etc.

Consequently, in either of the above cases, the device of the present invention outputs a warning, which may be in the form of lighting a warning lamp 20 by outputting an "ON" signal from the output port *7d* through a drive circuit 29, as shown in FIG. 1.

Figure 4:
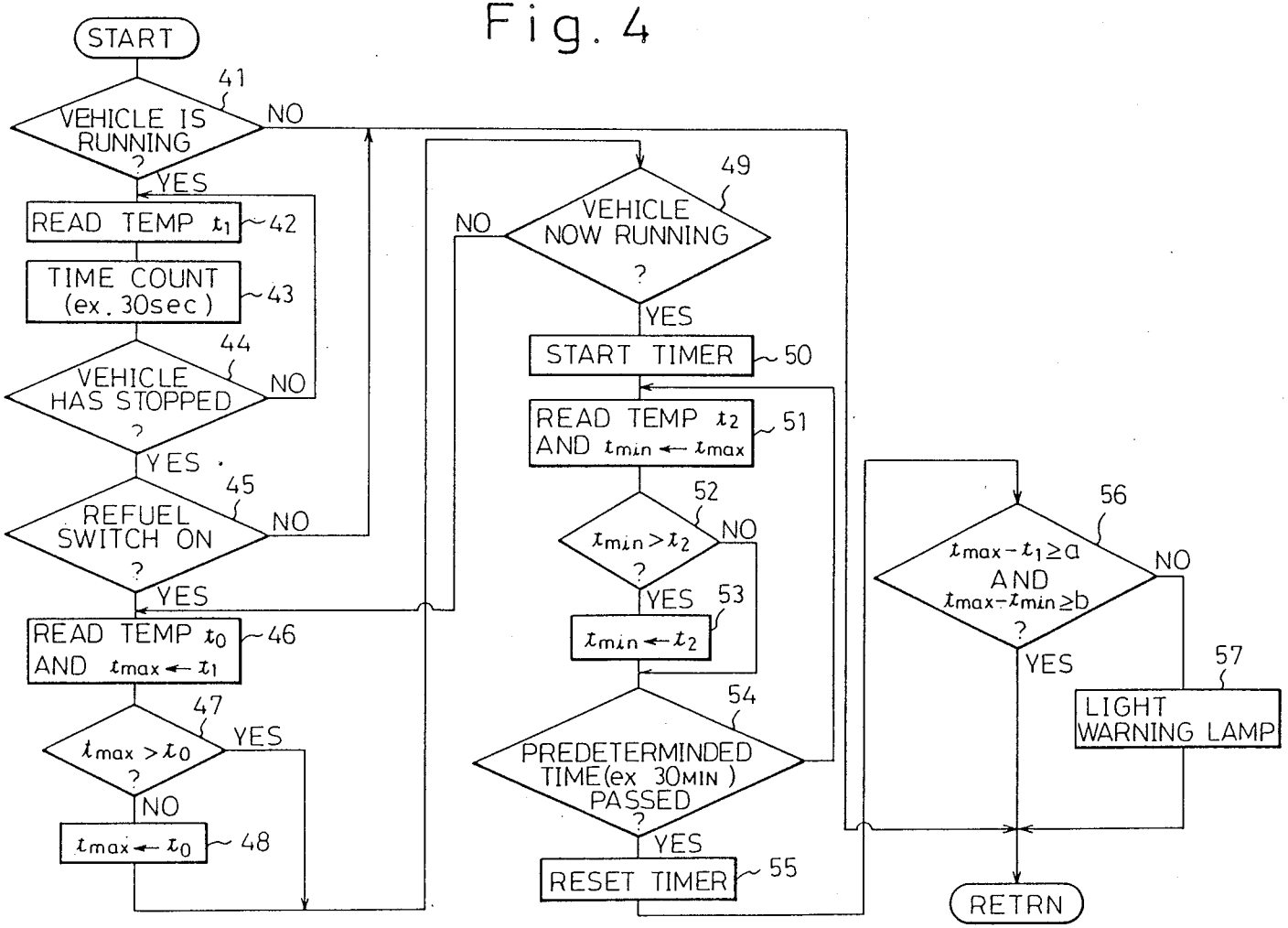

FIG. 4 is a flow chart of a routine for carrying out the above operation of the device of the invention. This routine is also executed independently from a main routine for carrying out the known control of the engine 9, since the former routine must be executed even when the engine 9 is stopped for fuel replenishment.

As shown in the figure, at step 41 it is determined whether or not the vehicle is running, by detecting a signal output from the vehicle speed sensor 14. If YES at step 41, i.e., if the vehicle is running, the process goes to step 42. If NO at step 41, the process goes to the last step in the figure and is returned to the first step 41.

At step 42, the temperature $t_1$ inside the canister 3 while the vehicle is running is detected by the temperature sensor 6, and the detected temperature $t_1$ is stored in a predetermined area of the memory *7b*. In general, since the temperature $t_1$ inside the canister 3 while the vehicle is running does not vary greatly in a short time, the detection of the temperature $t_1$ at step 42 need not be executed continuously, but can be carried out at predetermined intervals, for example, every 30 seconds. Therefore, according to the embodiment, the count of a time corresponding to the predetermined interval is executed at step 43.

At step 44, it is determined whether or not the vehicle has stopped, i.e., is parked, by detecting signals output from the vehicle speed sensor 14. If the result at step 44 is NO, i.e., if it is determined that the vehicle is still running, the process returns to step 42, at which the current temperature $t_1$ inside the canister 3 is detected, and the detected temperature $t_1$ is stored in the predetermined area of the memory *7b*, to replace the previous temperature $t_1$. If the result at step 44 is YES, the process goes to step 45, at which it is determined whether or not the fuel is being replenished, by detecting the "ON" signal from the refuelling switch 15. If YES at step 45, the process goes to step 46, but if NO at step 45, the process goes to the last step in the figure and is returned to the first step of the subsequent routine.

At step 46, a temperature $t_0$ inside the canister 3 during the fuel replenishment is detected by the temperature sensor 6.

Furthermore, at this step 46, a value of the temperature $t_1$ is provisionally set to a maximum temperature $t_{max}$ at a subsequent step as an initial value for renewing processes which will be described below.

Then, at step 47, it is determined whether or not the detected temperature $t_0$ is lower than the maximum temperature $t_{max}$ which has been stored in a predetermined area of the memory *7b*.

If the temperature $t_0$ detected at step 46 is higher than the maximum temperature $t_{max}$, i.e., if NO at step 47, the process goes to step 48 where the temperature $t_0$ detected in this routine is stored in the predetermined area of the memory *7b* as a renewed value, to replace the previous maximum temperature $t_{max}$.

If the temperature $t_0$ does not exceed the maximum temperature $t_{max}$, i.e., if YES at step 47, the process goes to step 49 bypassing step 48.

Then, at step 49, it is determined whether the vehicle is now running, by detecting the signal output from the vehicle speed sensor 14. Namely, this process at step 49 is provided to renew or hold the detected maximum temperature $t_{max}$ during parking. Therefore, if NO at step 49, the process returns to step 46, whereby the aforementioned processes from step 46 to step 48 are executed.

If YES at step 49, i.e., if the vehicle is now running, the process goes to step 50 where a timer (not shown) is started to count the above mentioned predetermined interval (for example, 30 minutes) after the vehicle is run.

Then, at step 51, the temperature $t_2$ inside the canister 3 while the vehicle is running is detected by the temperature sensor 6, and furthermore, a value of the temperature $t_{max}$ is provisionally set to a minimum temperature $t_{min}$ at a subsequent step as an initial value for renewing processes which will be described below. At step 52, it is determined whether or not the detected temperature $t_2$ is lower than the minimum temperature $t_{min}$ stored in the memory *7b*. If YES at step 52, the process goes to step 53 where the temperature $t_2$ detected in this routine is stored as a renewed value, to replace the previous minimum temperature $t_{min}$. If NO at step 52, the process bypasses step 53 and goes to step 54.

At step 54, it is determined whether or not the above predetermined time has passed after starting the timer at step 50. If the result at step 54 is NO, i.e., if the predetermined time has not passed, the process returns to step 51, and the minimum temperature $t_{min}$ is renewed or held by the aforementioned steps 52 and 53.

If the result at step 54 is YES, the process goes to step 55 where the timer started at step 50 is reset, i.e., initialized.

Then, at step 56, using the obtained newest temperatures $t_1$, $t_{max}$, and $t_{min}$, the calculation $(t_{max}-t_{min})$, and $(t_{max}-t_{min})$, as described in the inequalities (1) and (2), is executed, and further, it is determined whether or not the above calculated differences are higher than the predetermined values a and b, respectively. If YES at step 56, i.e., if the calculated differences meet the inequalities (1) and (2), this routine is ended and thus returns to the first step of the subsequent routine, as it is determined that the purge system is operating normally.

If NO at step 56, i.e., if at least one of the inequalities (1) or (2) is not satisfied, the process goes to step 57 and the control circuit 7 outputs an "ON" signal to light the warning lamp 20 through the drive circuit 29. Note, this lighting of the warning lamp 20 at step 57 can be also used to turn the lamp 20 ON and OFF to display a code corresponding to the kind of malfunction, i.e., the malfunction is derived from the absorption or purging of fuel vapor.

After step 57, the process reaches the last step and thus returns to the first step of the subsequent routine.

As described above, according to the present invention, by providing a means, such as a temperature sensor, for detecting a temperature inside the canister during the process from the absorption of the fuel vapor to the purging thereof, it is possible to quickly and precisely diagnose whether or not the purge system of engine is malfunctioning, whenever the vehicle is stopped.

Although the described embodiments are directed to a purge system which absorbs fuel vapor caused by an evaporation of fuel held in a fuel tank, when replenishing the fuel, various modifications may be made by those skilled in this art without departing from the scope of the invention. For example, the present invention can be applied to a purge system which absorbs the fuel vapor from the fuel tank whenever the vehicle is stopped, regardless of whether or not the fuel is replenished.

In this case, the refuelling switch 15 as shown in FIG. 1 and the processes at steps 22 and 45 as shown in FIGS. 2 and 4, can be omitted.

We claim:

1. A device for detecting a malfunction of a fuel evaporative purge system having a canister for absorbing fuel vapor caused by an evaporation of fuel held in a fuel tank, said purge system absorbing the fuel vapor at least when a vehicle is stopped, and purging the fuel vapor held in said canister to an engine of said vehicle when said vehicle is running, said device comprising:

means for detecting a temperature inside said canister;

means for calculating a change of said temperature when absorbing the fuel vapor and a change of said temperature when purging the fuel vapor means for determining whether or not a malfunction has occurred in said system by comparing said changes of temperature calculated by said calculating means with predetermined values.

2. A device according to claim 1, wherein said fuel evaporative purge system comprises a refuelling switch arranged at a fuel inlet of said fuel tank and activated when said fuel tank is replenished with fuel, and a valve arranged at a vapor inlet of a vapor passage connecting said fuel tank with said canister and opened when said refuelling switch is activated, whereby said purge system absorbs the fuel vapor when the vehicle is stopped and the fuel is replenished.

3. A device according to claim 2, wherein said fuel evaporative purge system further comprises a solenoid valve arranged in a purge passage connecting said canister with an intake pipe of said engine and opened when the vehicle is running, whereby said purge system purges the fuel vapor from said canister to said intake pipe when the vehicle is running.

4. A device according to claim 3, wherein said solenoid valve is opened when a speed of the vehicle is higher than a predetermined value.

5. A device according to any one of the preceding claims, wherein said detecting means comprises a temperature sensor inserted into said canister.

6. A device according to claim 5, wherein said calculating means calculates a difference between a maximum temperature of said temperature detected when the vehicle is stopped and said temperature detected just before the vehicle is stopped, and another difference between said maximum temperature and a minimum temperature among temperatures detected within a predetermined interval after the vehicle is run.

7. A device according to claim 6, wherein said determining means determines that a malfunction has occurred in said purge system when at least one of said calculated differences is lower than said corresponding predetermined value.

8. A device according to claim 7, wherein said determining means includes a warning lamp which is activated when a malfunction has occurred in said purge system.

9. A device according to claim 8, wherein said warning lamp is turned ON and OFF to display a code corresponding to the kind of malfunction that has occurred in said purge system.

10. A device according to claim 9, wherein said canister contains an activated carbon.

11. A device according to claim 10, wherein said canister is provided with a filter which cleans fresh air introduced thereinto, and plates support therebetween said filter.

* * * * *